United States Patent [19]

Becker et al.

[11] 4,419,171

[45] Dec. 6, 1983

[54] PORTABLE LABELING MACHINE

[75] Inventors: Werner Becker, Hirschhorn; Heinz Kistner, Neckarsteinach; Kurt Schrotz, Beerfelden, all of Fed. Rep. of Germany

[73] Assignee: Esselte Pendaflex Corporation, Garden City, N.Y.

[21] Appl. No.: 372,650

[22] Filed: Apr. 28, 1982

[30] Foreign Application Priority Data

May 13, 1981 [CH] Switzerland ..... 3098/81

[51] Int. Cl.[3] ..... B65C 11/02

[52] U.S. Cl. ..... 156/384; 101/288; 101/291; 101/305; 101/359; 156/577; 156/579; 156/584; 156/DIG. 49

[58] Field of Search ..... 156/384, 344, 577, 579, 156/584, DIG. 48, DIG. 49; 101/288, 295, 305, 359, 291

[56] References Cited

U.S. PATENT DOCUMENTS

| | | | |
|---|---|---|---|
| 4,094,724 | 6/1978 | Sato | 156/384 |
| 4,240,348 | 12/1980 | Sato | 101/305 |
| 4,313,377 | 2/1982 | Sato | 101/295 |
| 4,356,767 | 11/1982 | Sato | 101/295 |

FOREIGN PATENT DOCUMENTS

WO79/01109 12/1979 PCT Int'l Appl. .

*Primary Examiner*—Michael G. Wityshyn

*Attorney, Agent, or Firm*—Hedman, Casella, Gibson, Costigan and Hoare

[57] ABSTRACT

The machine intended for printing two lines of characters of different color (8, 9) on self-adhesive labels comprises two printheads mounted in a rocking housing (7).

This housing comprises two holding elements (14, 16) engaged in two guide slots (17, 19), and a drive finger (15) engaged in a fork (18) of a drive lever (13) actuated by a trigger (3).

The slots have shapes which are so adapted that upon the printing impact of the two lines of characters on a print platen (12) the rocking of the housing is transformed into a translation which is not affected by the play and movements of the drive lever and is oriented towards the print platen.

Two inking rollers of different color (22, 23) are mounted in a common retractable support (24) by means of a mechanism (26, 29, 30) intended to assure the selective inking of the two lines of characters.

10 Claims, 6 Drawing Figures

PORTABLE LABELING MACHINE

The present invention has as its object a portable labeling machine intended to be operated by hand in order to print legends in different colors on self-adhesive labels and to adhere the labels onto articles intended for sale.

Machines of this type are already known which, like the machine of the present invention, have a housing provided with a handle with actuating trigger and comprising at least two rocking printheads for printing at least two lines of characters of different colors on self-adhesive labels borne by a continuous support strip, a drive lever connected to the trigger and to the printheads to displace the latter, guide slot links rigidly connected to the housing for guiding the rocking of the printheads from a raised inking position to a lowered printing position, a print platen rigidly connected to the housing, and at least two inking rollers of different colors arranged in the path of the lines of characters of the printheads in the raised position of the latter.

These machines furthermore, as in all portable labeling machines, have a device for the step-by-step feeding of the support strip adapted to advance the latter by the length of one label upon each actuation of the trigger and a device for the separating and dispensing of the printed labels from the continuous strip out of the housing in order to permit their attachment by adhesive pressure on the articles to be labeled.

On these machines, which must be as compact and light as possible, the problem consists in imparting the printing device the smallest size and lowest weight, while assuring the selecting and inking of the lines of characters and the quality of the printing.

As a matter of fact, as compared with the present machines having a single line of printing, the increase in the number of printheads and of inking rollers as well as in the space necessary for their relative displacements for selective inking in different colors by rocking of the printheads results in an increase in the weight of the machine and of its interior volume. Furthermore, as the printing impact results from a rocking movement the curved path of which is not directed towards the zone of impact, relative sliding can take place between the lines of characters and the print platen, altering the quality of the printing.

In one known machine, described in published Patent Application PCT/GB-79/00075, the two printheads are independent of each other and move over two rocking paths which are substantially symmetrical with respect to the vertical to the print impact zone so as to be able to move apart from each other in raised position in order independently to ink their two lines of characters on two inking rollers of different colors and be able, in lowered position, to move towards each other before said impact. In order to arrive at this result, the two printheads are articulated independently by their upper ends at two points spaced apart from each other on the drive lever and are guided independently by their lower ends in two curved slots located on opposite sides of the vertical to the impact zone with respect to the plane of the print platen. In this structure, the two inking rollers are in stationary positions within the housing and located also in positions spaced apart from each other and substantially symmetrical on opposite sides of the vertical in question, at the end of the path of lift of the printheads. In order to preserve the quality of the print of the two lines of characters, the lower terminal portion of the two curved slots is oriented perpendicular to the print platen in order to avoid any relative sliding between the print lines and the print platen at the time of impact.

The object of the invention is, pursuant to a different concept of the guiding of the printheads and of the selection of the inking of their characters, to increase the quality of the printing and reduce the size of the printing device while guaranteeing ease of access to the elements intended to be replaced, checked or handled periodically, such as the inking rollers, the printheads and the label support strip.

For this purpose, the portable labeling machine of the invention is characterized by the fact that the two printheads are mounted and fixed side by side in a common rocker housing which has, on at least one of its two side-walls, a pivot, a drive finger and a guide finger, the three of which are spaced apart from each other in the order indicated; by the fact that the pivot is engaged in a first linear slot and is oriented towards the print platen; by the fact that the drive finger is arranged resting continuously against the drive lever; by the fact that the guide finger is engaged in a second slot having an upper portion in the shape of a circular arc centered on the upper portion of the first slot, considered with reference to the print platen, and a lower linear portion also oriented towards the print platen; by the fact that the two inking rollers are mounted side by side in position corresponding to that of the two printheads; and by the fact that at least that one of these two rollers which is located in the path of the two lines of characters of different colors is mounted in a retractable movable support which is actuated by a retraction mechanism controlled by the rocking of the rocking housing.

In this way, the selective inking by retraction of at least one inking roller, which permits the mounting and fastening of the two printheads in a common rocking housing as well as the grouping of the two inking rollers at one and the same place on the circular path of their two lines of characters, makes it possible to reduce by one-half the space necessary for the rocking of these two heads, since a single rocking path is sufficient. Due to this also any possible residual sliding of the lines of characters at the time of the impact is not worsened by the sum of their individual effects since these two lines are here immobilized in space with respect to each other in a common rocking housing. Furthermore, in the manner of guidance of the rocking which is adopted, the two printheads are integrally supported and guided by stationary slot links rigidly connected with the housing of the machine, while the drive lever, which is movable acts solely as drive element by resting against the drive finger; therefore, the precision of the printing impact is no longer subject to the functional play of the said drive lever and the quality of the printing is improved thereby. Finally, the grouping of the two printheads and of the two inking rollers at one and the same place provides greater freedom in the selection of the position to be imparted to them within the housing of the machine in order to facilitate access thereto.

Other advantages inherent in the invention, such as in particular the possibility of selecting the point of application of the force imparted by the drive lever as a function of the selected distribution of the forces developed by the rocking of the printheads, will becomme clearly evident from the description which follows.

The accompanying drawing shows, by way of example, one embodiment of the object of the invention as well as a variant of one of its component elements.

Figures 1, 2:
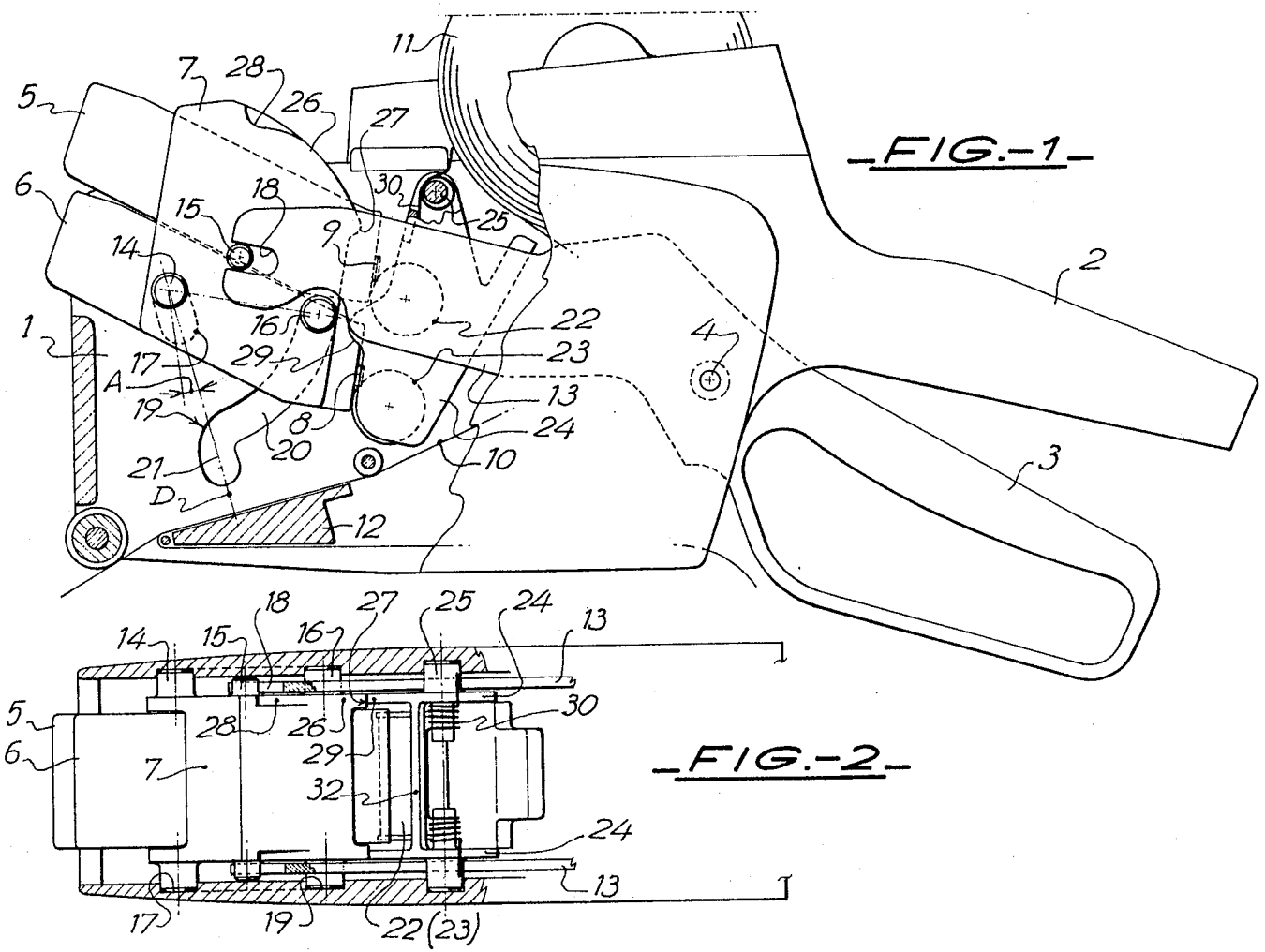
FIG. 1 is an overall view in elevation and partial section of the embodiment, shown in rest configuration.
FIG. 2 is a partial top view thereof.

The portable labeling machine shown in FIGS. 1 to 5 comprises a housing 1 provided with a carrying handle 2 with actuating trigger 3 articulated on a trunnion 4.

In this example, this machine comprises two printheads 5 and 6 with incorporated character selector, they being mounted and fixed side by side in a common rocking housing 7 and being intended to imprint two lines of characters 8 and 9 of different colors on self-adhesive labels borne by a continuous strip 10 coming from a roll 11 housed in the upper portion of the housing 1.

This assembly is located above a print platen 12 rigidly connected with the housing 1, over which platen the course of the continuous strip 10 passes, and between the two arms of a drive lever 13 intended to activate the rocking housing 7 and is articulated to the trunnion 4. This lever 13 is here formed of an extension of the trigger 3.

The rocking housing 7 has, on each of its two sidewalls, a pivot 14, a drive finger 15, and a guide finger 16, the three being spaced apart from each other in the order indicated, here from left to right in the rest configuration shown in FIG. 1.

Each pivot 14 is engaged in a first linear slot 17 provided in each side-wall of the housing 1 of the machine and oriented perpendicular to the plane of the print platen 12.

Each drive finger 15 is arranged continuously resting in an end fork 18 of an arm of the drive lever 13.

Each guide finger 16 is engaged in a second guide slot 19, also provided in each side wall of the housing 1 of the machine and having an upper portion 20 in the form of a circular arc centered on the upper portion of the first slot 17, considered with reference to the print platen 12, and a lower linear portion 21 aligned with the first linear slot 17 and therefore also perpendicular to the plane of the print platen 12 along a straight line D.

From this assembly it results that the actuating of the trigger 3 produces a force applied to the drive finger 15 which has the effect of first of all rocking the rocking housing 7 around its pivot 14 held in the upper portion of the first slot 17 during the path of the arc-shaped portion 20 of the second slot 19 by the guide finger 16, and then of causing it to descend perpendicular to the print platen 12 until the moment of the impact of the striking of the characters on the print platen 12 during a common, equal path of translation of the pivot 14 in the first linear slot 17 and of the guide finger 16 in the lower linear portion 21 of the second slot 19. During this forced combined movement of rocking and translation of the rocking housing 7, the latter is guided only by the two slots 17 and 19 and the precision of the impact of the characters on the print platen 12 is not affected by the operating play of the lever 13 on the trunnion 4 or of the drive finger 15 in the fork 18 of the said lever.

Upon the release of the trigger 3, the latter is pulled back into lowered position of rest by a return spring (not shown) which is held between it and the handle 2, the drive lever 13 rising again and causing the rocker housing 7 to pass in opposite direction over the said path. Shortly before the end of this rise, the two lines of characters 8 and 9 are inked by two inking rollers 22 and 23 of different colors which are mounted side by side in position corresponding to that of these two lines of characters and on their path, between the two side walls of a retractable movable support 24 articulated here at their upper portions by a trunnion 25 engaged in a bearing borne by the two walls of the housing 1.

The selective inking of the two lines of characters of different colors is obtained by a mechanism for the re-traction of the movable support 24, established in relationship with the rocking housing and controlled by the rocking of the latter, which has the effect of avoiding the upper line of characters 9 coming into contact with the lower inking roller 23 which is not of the color intended for it, both during the descent and during the rising of the two lines of characters. This retraction mechanism is formed here by the combination of a cam 26 formed by a contour in the shape of a circular arc of each side-wall of the rocking housing 7, centered on the pivot 14, following a rise 27 and terminated by a trough 28, of a push member 29 formed by a protrusion of the two side-walls of the movable support 24 which for this purpose have the same spacing as the said walls of the rocking housing 7, and of a spring 30 which assures the contact of these parts as well as the inking pressure.

Figure 5:
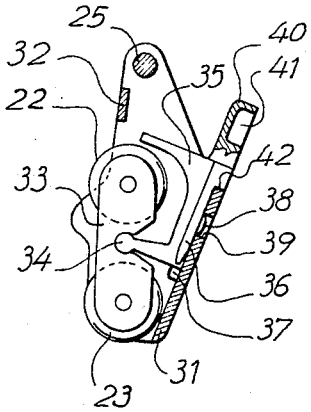
FIG. 5 is a detail view, also in elevation, of one of its parts.

The mounting of the two inking rollers 22 and 23 in the retractable movable support 24 is shown in detail in FIG. 5. In this figure it can be seen, first of all, that the two walls of this support 24 are connected by a flat bottom 31 and by an upper cross member 32, close to the trunnion 25, also visible in FIG. 2, on which the pressure of the spring 30 is applied.

The two inking rollers 22 and 23 are supported at a fixed distance apart corresponding to the distance between the two character lines 8 and 9 of the printheads by a rocker 33 articulated at its central portion on a pivot 34 borne by a removable slide 35. This slide has two rail-shaped lateral projections 36 engaged in two slideways 37 provided in the two sidewalls of the said movable support, as well as a central retaining protrusion 38 having the shape of a portion of a sphere, engaged in a cylindrical hole 39. An extension 40 of this slide 35, having a grip depression 41, forms a grip which facilitates its withdrawal from and introduction into the movable support, the elasticity of the flat bottom 31 of the latter permitting the liberating or engagement of the projection 38 in the hole 39. An end-of-stroke stop 42, consisting of a projection from the extension 40, assures the correct positioning of the slide in the movable support.

This particular mounting of the two inking rollers, which is not indispensable in order to assure the proper operation of the printing device described, has the advantage however of equally distributing the inking pressure over the two lines of characters 8 and 9 as well as the advantage of facilitating the replacement of the two inking rollers, without requiring the removal in situ of each of them. These advantages are inherent in the possibility afforded by the invention of mounting the two inking rollers of different colors side by side at the same place.

Figure 3:
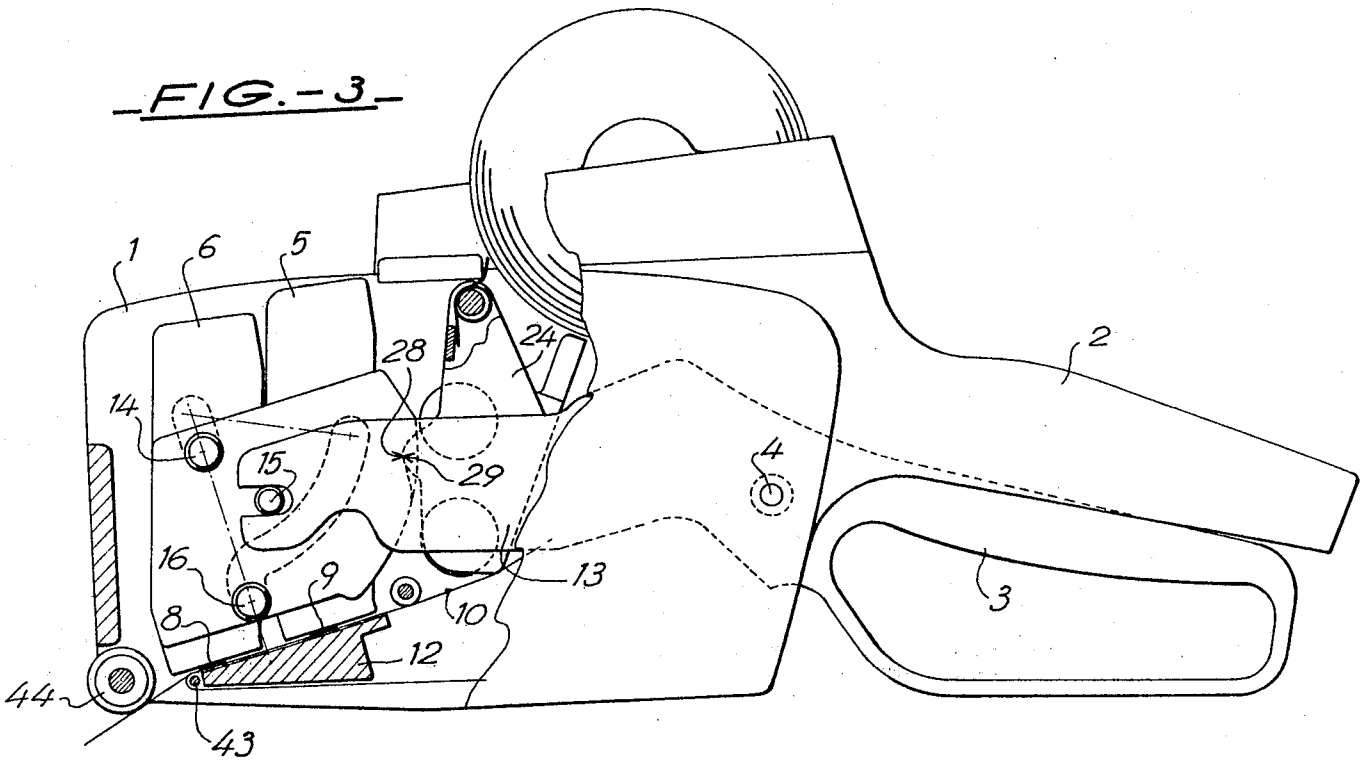
FIG. 3 is a second overall view thereof in relation in partial section, shown in printing configuration.
Figure 4:
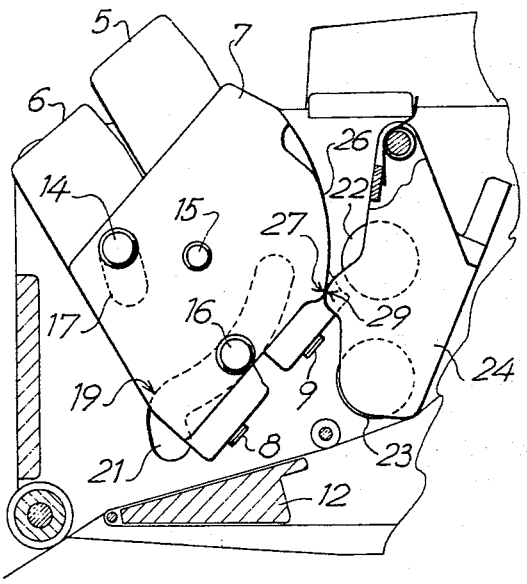
FIG. 4 is a partial view in elevation and in section shown in intermediate configuration.

The combined kinematic system consisting of the driver lever 13, the rocking housing 7 and the retractable movable support 24 can be easily noted by observation of FIGS. 1, 3 and 4.

In FIG. 1, in which this assembly is shown in configuration of rest, which precedes and follows the displacements of the rocking housing 7, it can be seen that the close-together position of the drive finger 15 with respect to the pivot 14 makes it possible to transmit to the rocking housing a relatively gentle force at the start of the actuating cycle. It is thus possible to define this relative position as a function of the value of the force selected to be transmitted. This advantageous possibility is inherent in the possibility offered by the invention of disconnecting the point of application of the force of the lever 13 from the guide points of the rocking housing. From this same figure it can be noted that the two inking rollers 22 and 23 are held in elastic contact by the spring 30, with the two lower plates of the two printing units 5 and 6 ready to ink with different colors the two lines of characters 8 and 9, which is effected at the very start of the drive cycle, the push member 29 not yet being in contact with the cam 26.

During the rocking of the rocking housing 7, caused by the actuation 3, and at the time when the upper line of characters 9 comes against the lower inking roller 23 which is not of its color, in the intermediate configuration shown in FIG. 4, the push member 29 encounters the rise 27 of the cam 26 and moves the movable support 24 away sufficiently in order that any possible limited oscillations of the rocker 33 (FIG. 5), which has been released do not lead to an undesirable residual inking. This spacing is then maintained along the circular-arc-shaped portion of the cam 26 until the guide finger 16 of the rocking housing 7 arrives in the linear portion 21 of the second slot 19. It can be noted here that during this rocking cycle of the housing 7, the force transmitted by the lever 13 gradually increases.

When the guide finger 16 arrives in the said linear portion, the retention of the pivot 14 in the upper end of the first linear slot 17 is freed and the rocking housing 7 is directed towards the print platen 12 in accordance with a movement of translation the linear vector of which is perpendicular to the platen. At the end of this translation, in the printing configuration shown in FIG. 3, the printing impact of the two lines of characters 8 and 9 takes place on a label borne by the continuous strip 10 applied on the printing platen 12. At the end of this translation, also the push member 29 of the movable support 24 is engaged in the terminal trough 28 of the cam, but this feature is not indispensable for the purpose of the invention.

From this FIG. 3 it can be seen that the printing of the two lines takes place in the region of the print platen 12 which is closest to the front wall of the machine, which customarily comprises an edge 43 for separating the printed labels from the support strip 10 and a press roller 44 intended for the gluing of the said labels by pressure onto the articles to be labeled. This possibility, which is inherent in the invention and makes it possible to have only a single rocking path for the two printheads and which can therefore be oriented towards the inside of the housing 1, avoids the loss of a label upon each change of the characters of the printing lines.

Figure 6:
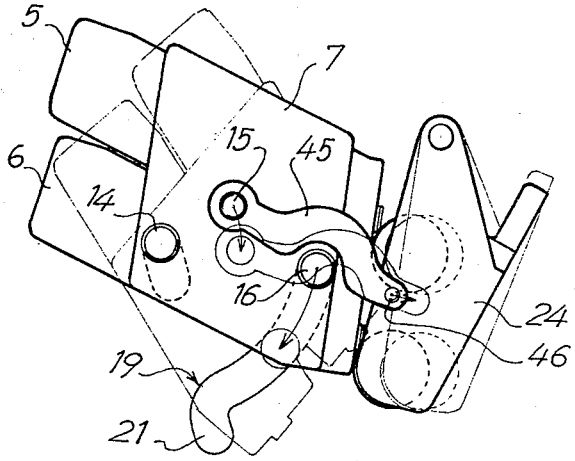
FIG. 6 is a view in elevation of the variant.

The retraction mechanism for the rocking housing 24 can also be formed of a linkage of the connecting-rod/-crank type shown in FIG. 6.

In this figure, this linkage as well as the two members which it connects, namely the rocking housing 7 and the movable support 24, are shown in two configurations distinguished by the thickness of the lines.

The heavy-line configuration corresponds to the configuration of rest shown in FIG. 1 while the thin-line configuration corresponds to the intermediate configuration shown in FIG. 4.

This linkage is formed by a connecting rod 45 articulated at one end to a crank pin fastened to the rocking housing 7, formed here of the drive finger 15 of this housing, and at the other end to a second pivot 46 fastened to the retractable movable support 24 in the place and stead of the center of curvature of the push member 29 of the embodiment previously described. In top view, this connecting rod 45 must be located between the alignment of the side walls of the housing 7 and the support 24 and the inner face of an arm of the drive lever 13, referring to FIG. 2, this arm being designed spaced sufficiently away for this purpose.

In this linkage, the upper dead center corresponds to the position of maximum retraction desired for the movable support 24. The articulation points of the connecting rod 45 may be different from those indicated. The positions of these points will be selected each time as a function of the geometrical loci of geometrical encounter and retraction which are defined by the lever arms of the moving members and the path of their active elements.

Other variants, not shown, may be made, namely:

- A double printhead can be mounted in place of the two independent heads 5 and 6 in the rocking housing 7.
- The drive lever 13 can be articulated independently of the trigger 3, as for instance in the known labeling machines with assisted uniform-pressure drive.
- All the elements, arranged in duplicate on both sides of the vertical plane of symmetry of the machine, such as the pivot 14, the drive finger 15, the guide finger 16, the cam 26 and the push member 29, can be arranged in a single unit on a single side of said plane.
- The end fork 18 of the drive lever 13 can be replaced by a slot, or else this arrangement can be reversed; that is to say the lever 13 may bear a drive finger which is engaged in a slot provided in the housing 7, which constitutes an equivalent from a functional standpoint.
- A single inking roller, the lower roller 23, can be mounted in the retractable support 24 since only this roller can encounter the two lines of characters 8 and 9 during the rocking of the housing 7. In this case, the other roller 22 can be mounted in fixed position, but the additional advantages offered by the mounting described will then no longer be obtained.
- The mobility of the retractable support 24 can be obtained by translation instead of pivoting.
- Finally, the alignment of the lower portion 21 of the second slot with the first slot 17 as well as their perpendicularity to the plane of the print platen can be eliminated or modified in certain special cases.

Thus, first of all the slot 17 may no longer be aligned with the lower portion 21 of the second slot but rather simply parallel to the latter, provided, however, that the upper portion of this slot 17 still constitutes the center of the circular-arc shaped portion 20 of the second slot 19. This variant can also be employed for practical reasons of space, for instance.

Depending on the location of the center of gravity of the said rocking assembly consisting of the housing 7 and the printheads 5 and 6, a slight shift may take place in the point of application of the striking force of this assembly at the time of the impact with respect to the two lines of characters 8 and 9 due to the inertia developed by this assembly during its rocking, which would have the result of differentiating the printing forces applied to these two lines of characters and of thus producing a difference in the intensity of their printing. In this case it is advantageous either slightly to incline the two said slots 17 and 21 with respect to the vertical to the printing platen 12 while retaining their alignment or parallelism, or to retain the perpendicularity of the lower portion 21 of the second slot with the print platen and to orient the first slot 17 in such a manner as to form an acute angle A with the straight line D (FIG. 1), which angle opens on the side opposite the circular-arc shaped portion 20 of the second slot 19 so as to counterbalance the said undesirable effect.

What is claimed is:

1. A portable labeling machine having a housing (1) provided with a handle (2) with actuating trigger (3) and comprising at least two rocking printheads (5, 6) for printing at least two lines of characters of different colors on self-adhesive labels borne by a continuous support strip, a drive lever (13) connected to the trigger and to the printheads in order to move the latter, guide slides rigidly secured to the housing to guide the rocking of the printheads from a raised inking position to a lowered printing position, a print platen (12) rigidly connected to the housing, and at least two inking rollers (22, 23) of different colors disposed in the path of the lines of characters of the printheads in the raised position of the latter, characterized by the fact that the two printheads (5, 6) are mounted and fixed side by side in a common rocking housing (7) having, on at least one of its two side-walls, a pivot (14), a drive finger (15) and a guide finger (16), the three being spaced apart from each other in the order indicated; by the fact that the pivot is engaged in a first slot (17) which is linear and directed towards the print platen; by the fact that the drive finger is arranged continuously bearing against the drive lever; by the fact that the guide finger is engaged in a second slot (19) having an upper portion (20) in the form of a circular arc centered on the upper portion of the first slot, viewed with reference to the print platen, and a linear lower portion (21) which is also directed towards the print platen; by the fact that the two inking rollers (22, 23) are mounted side by side in a position corresponding to that of the two lines of characters; and by the fact that at least that one of the two rollers which is located on the passage of said two lines of characters is mounted in a retractable movable supprt (24) which is actuated by a retraction mechanism (26,29,30)(15,45,46) controlled by the swiveling of the rocking housing (7).

2. A machine according to claim 1, characterized by the fact that the first linear slot (17) and a linear lower portion (21) of the second slot are parallel to each other.

3. A machine according to claim 1, characterized by the fact that the first linear slot (17) and the lower linear portion (21) of the second slot are aligned with each other.

4. A machine according to claim 2 or claim 3, characterized by the fact that the first linear slot (17) and the lower linear portion (21) of the second slot are perpendicular to the print platen (12).

5. A machine according to claim 1, characterized by the fact that the lower linear portion (21) of the second slot is perpendicular to the print platen (12) while the first linear slot (17) forms an acute angle (A) with said lower portion, said angle being open on the side opposite the circular-arc portion (20) of said second slot.

6. A machine according to claim 1, characterized by the fact that the two inking rollers (22, 23) are arranged side by side in a rocker (33) which is articulated and mounted in the retractable movable support (24).

7. A machine according to claim 6, characterized by the fact that the rocker (33), in which the two inking rollers are arranged, is removably mounted in the retractable movable support (24).

8. A machine according to claim 7, characterized by the fact that the rocker (33) in which the two inking rollers are arranged is articulated at its central portion on a pivot (34) borne by a removable slide (35) which is mounted in the retractable movable support (24).

9. A machine according to claim 1, characterized by the fact that the retraction mechanism for the retractable movable support is formed by the combination of a cam (26) which is rigidly connected with the rocking housing (7), a push member (29) which is rigidly connected with the said movable support, and a spring (30) which assures contact between these two parts as well as the inking pressure.

10. A machine according to claim 1, characterized by the fact that the retraction mechanism of the retractable movable support is a connection of the connecting-rod/crank type comprising a crank pin (15) fastened to the rocking housing (7) in a position spaced from the pivot of the latter and a connecting rod (45) established between said crank pin and a second pivot (46) fastened to the retractable movable support, the dead center of said connection corresponding to the retracted position.

* * * * *